United States Patent [19]

Talpo

[11] Patent Number: 4,594,488

[45] Date of Patent: Jun. 10, 1986

[54] HIGH-VOLTAGE ELECTRIC SWITCH WITH ARC EXTINGUISHING DEVICE USING SELF-GENERATION OF A QUENCHING PRESSURE

[75] Inventor: Gianpietro Talpo, Bergamo, Italy

[73] Assignee: Sace S.p.A. Costruzioni Elettromeccaniche, Bergamo, Italy

[21] Appl. No.: 730,445

[22] Filed: May 6, 1985

[30] Foreign Application Priority Data

May 10, 1984 [IT] Italy ..... 20871 A/84

[51] Int. Cl.[4] ..... H01H 33/70

[52] U.S. Cl. ..... 200/148 R; 200/145; 200/146 R; 200/148 A

[58] Field of Search ..... 200/148 R, 148 A, 145, 200/146 R

[56] References Cited

U.S. PATENT DOCUMENTS

| | | | |
|---|---|---|---|
| 2,420,889 | 5/1947 | Leeds | 200/150 E |
| 3,985,988 | 10/1976 | Korner et al. | 200/148 R |
| 4,239,949 | 12/1980 | Kii et al. | 200/148 R |
| 4,243,860 | 1/1981 | Kii | 200/148 R |

FOREIGN PATENT DOCUMENTS

| | | | |
|---|---|---|---|
| 715898 | 10/1931 | France | 200/150 E |
| 841273 | 2/1939 | France | 200/150 E |
| 317124 | 12/1971 | U.S.S.R. | 200/144 R |

*Primary Examiner*—Robert S. Macon

*Attorney, Agent, or Firm*—Diller, Ramik & Wight

[57] ABSTRACT

A high-voltage electric switch is proposed comprising an arc extinguishing device using self-generation of a quenching fluid pressure. Inside a container there is formed a compression chamber surrounded by fixed main contacts cooperating with mobile main contacts carried by a movable rod. Movable to a limited extent by said rod during its closure travel against elastic means, there are disposed in said chamber a first pair of arcing contacts for forming an auxiliary arc the main purpose of which is to generate a pressure in the quenching fluid contained in the compression chamber, and a second arcing contact which cooperates with the rod in order to form a main interruption arc which is blasted at the appropriate time by the thus compressed fluid, the arcing contacts being in series with each other and in parallel with the main contacts.

6 Claims, 4 Drawing Figures

Figure 1:
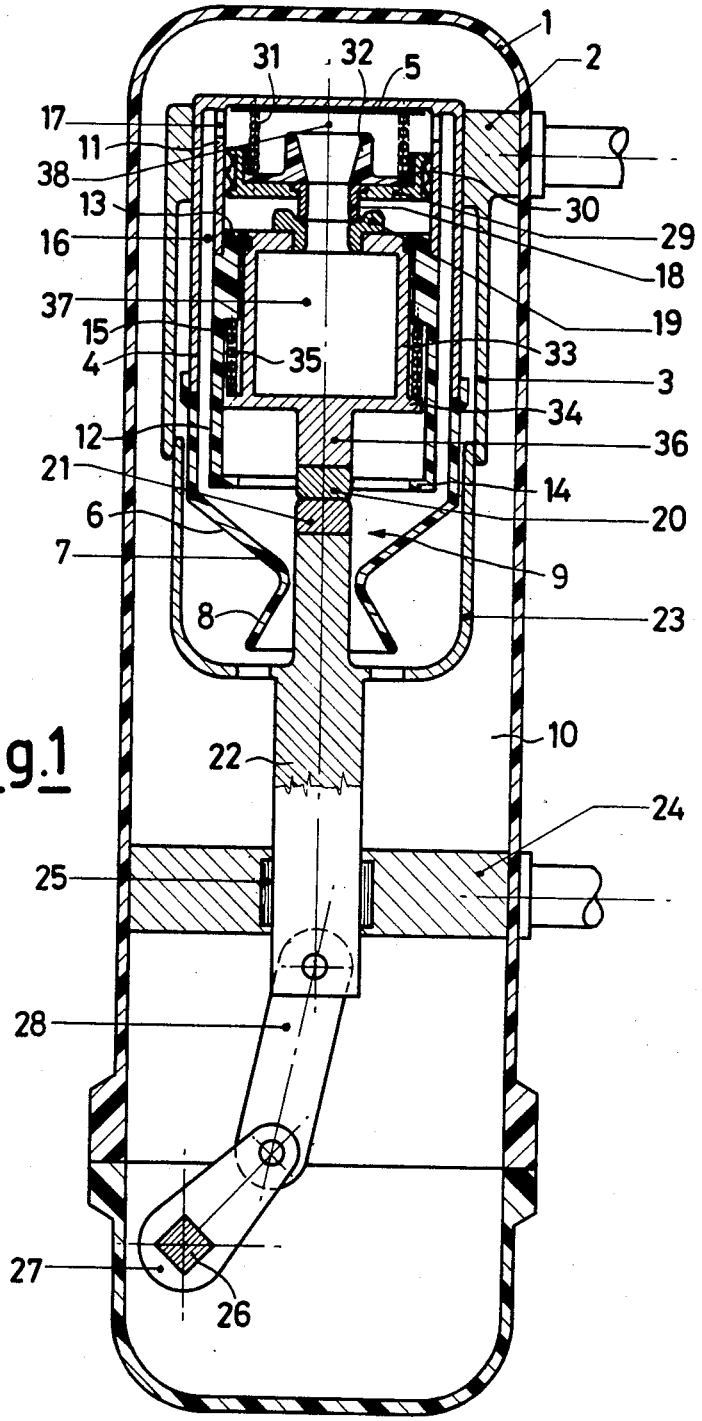

HIGH-VOLTAGE ELECTRIC SWITCH WITH ARC EXTINGUISHING DEVICE USING SELF-GENERATION OF A QUENCHING PRESSURE

This invention relates to a high-voltage electric switch with an arc extinguishing device using self-generation of a quenching fluid pressure.

Switches of this type are known, in which each pole is constituted by a hermetically sealed insulating container filled with the quenching fluid, in particular a gas such as sulphur hexafluoride, and divided by an insulating separation wall into a compensation chamber and a compression chamber which encloses fixed contacts, a movable contact rod being able to move through an aperture in the separation wall in order to connect together the two chambers after a determined path of opening travel, said fixed contacts provided in the compression chamber being arranged to create, in cooperation with the movable contact rod during its opening travel, two arcs in succession, of which one is a primary auxiliary arc which, by heat, serves to generate the pressure of the quenching gas for extinguishing a second main interruption arc.

Because of the fact that the energy which is generated by current in arc extinguishing devices of this kind depends obviously on the arc intensity and thus on the current to be interrupted, in order to make the device suitable for interrupting both weak currents and strong currents, various special arrangements have already been proposed such as making the volume of the quenching gas compression chamber vary as a function of the intensity of the current to be interrupted (see for example French Pat. No. 23 69 673), or adding to the system for self-generating the quenching gas pressure a mechanical cylinder-piston compression system (see for example French Pat. No. 23 73 141).

The first of these methods requires either several compression chambers with preset valve means in the wall which separates them or a compression chamber with a wall mobile against the action of preset elastic means, the provision in the compression chamber of two fixed auxiliary contacts in series with the main contacts, and a partially hollow movable contact rod provided with radial discharge orifices. This method also comprises a blowout coil for generating a magnetic blowout.

The second method requires a special cylinder with a blasting piston provided with supplementary means for delaying the blasting action, in addition to fixed auxiliary contacts in series with the main contacts, the hollow movable contact rod provided with radial orifices and the magnetic blowout coil which are also provided in said first known method.

A mixed system for generating the necessary quenching gas pressure, both by self-generation by the heating effect of an auxiliary arc, and by mechanical compression by a cylinder-piston assembly, has also been proposed for example in German Pat. No. 23 50 832, but this method comprises a double system of main and arcing contacts in series, and therefore requires considerable longitudinal-axial space in the container which constitutes the pole.

The object of the present invention is therefore to provide a high-voltage electric switch with an arc extinguishing device which uses exclusively the self-generation of a quenching fluid pressure and is therefore without means for mechanically compressing the fluid and/or means for generating a magnetic blowout, and which using a single compression chamber without valve means or mobile walls and by means of a simple construction of relatively small overall size and safe and reliable operation allows weak and strong currents to be interrupted at the first current zero after separation of the mobile and fixed arcing contacts.

This object is attained according to the invention by an electric switch of the initially defined type, characterised in that the compression chamber has a fixed volume and is at least partly surrounded by fixed main contacts cooperating with mobile main contacts carried by said movable contact rod, there being disposed inside the compression chamber in a manner movable to a limited extent by the movable contact rod during its closure travel against the action of elastic means a first pair of cooperating arcing contacts designed to create the primary auxiliary arc and a second arcing contact cooperating with the movable contact rod and designed to create the main interruption arc therewith, said arcing contacts being electrically in parallel with the main contacts and in series with each other.

Advantageously, one of the contacts of said first pair of arcing contacts is mounted movable to a limited extent against the action of autonomous first elastic means, whereas the second contact of said first pair of arcing contacts is rigid with said second arcing contact cooperating with the movable contact rod and forms therewith an element which is movable to a limited extent and subjected to the action of separate second elastic means.

The element carrying said two arcing contacts can be constituted by a hollow member surrounding an auxiliary chamber inside the compression chamber and in communication therewith by way of suitable passages, so that the quenching gas which is compressed in the auxiliary chamber and in the compression chamber by the effect of the primary auxiliary arc discharging from the compression chamber into the compensation chamber at the moment in which the preferably nozzle-shaped passage aperture in the separation wall between the compression chamber and compensation chamber becomes freed by the movable contact rod, prevalently encounters the main arc.

In a further embodiment, said element carrying said two arcing contacts can be constituted by a single disc carrying the two hollow arcing contacts and provided with passage ports in order to put the compression chamber into communication with the nozzle-shaped aperture in the wall which separates it from the compensation chamber, and in this case the compressed quenching gas which escapes when said nozzle is opened by the movable contact rod involves both the arcs in series in its cooling action. By suitably choosing the volumetric dimensions of the compression and collection chamber for the compressed quenching gas and coordinating the distance between the arcing contacts and the moment in which the first auxiliary arc arises during the opening travel with respect to the electric current wave, a gas blast is able to be obtained on the second generated arc such that interruption occurs before the first current zero.

The dimensioning of the paths of travel of the arcing contacts and the distances between them can in any case be such that following any restriking of the main arc, the auxiliary arc in series with it also restrikes in order to restore the operating conditions, thus giving rise to interruption at the next current zero.

Figure 2:
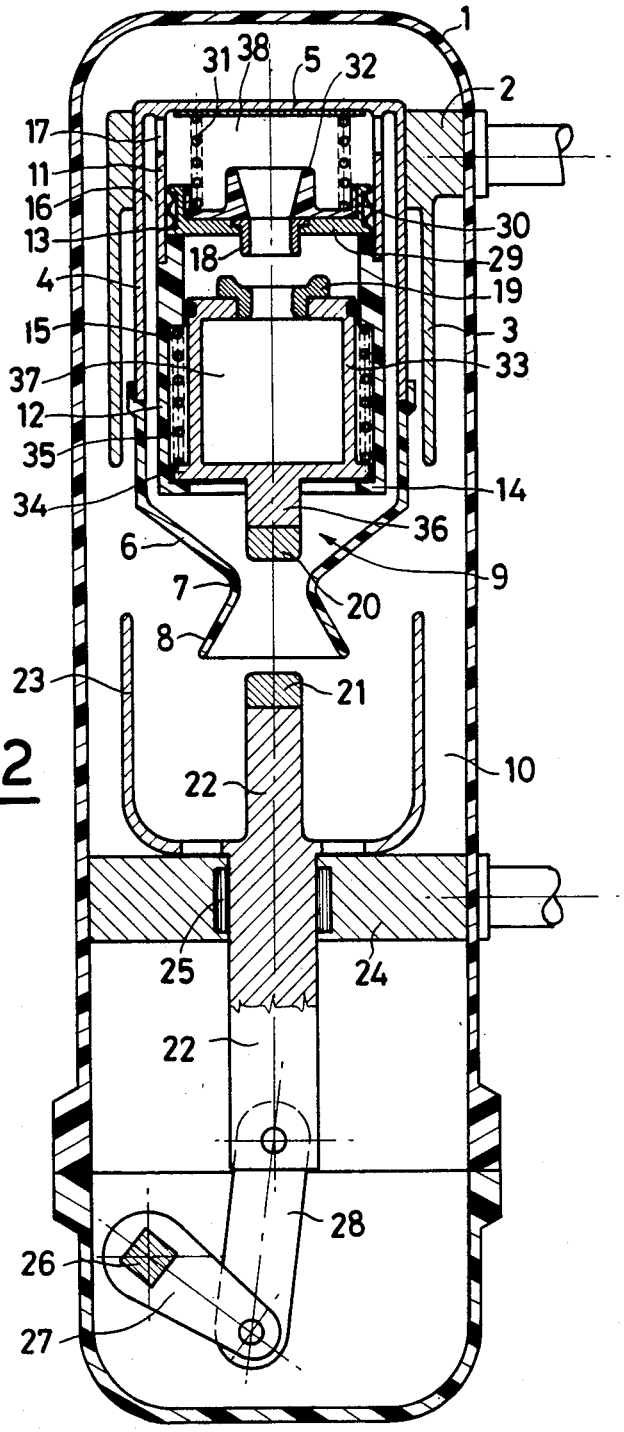
Figure 3:
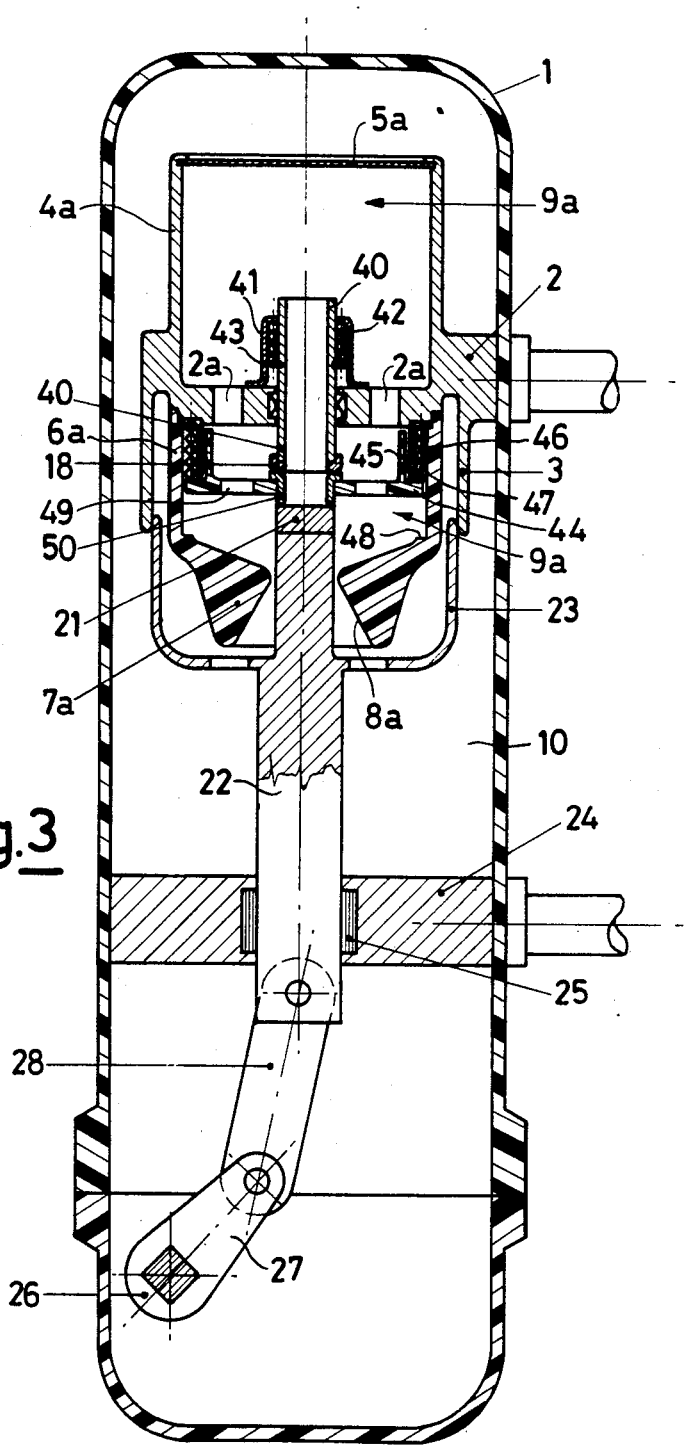
Figure 4:
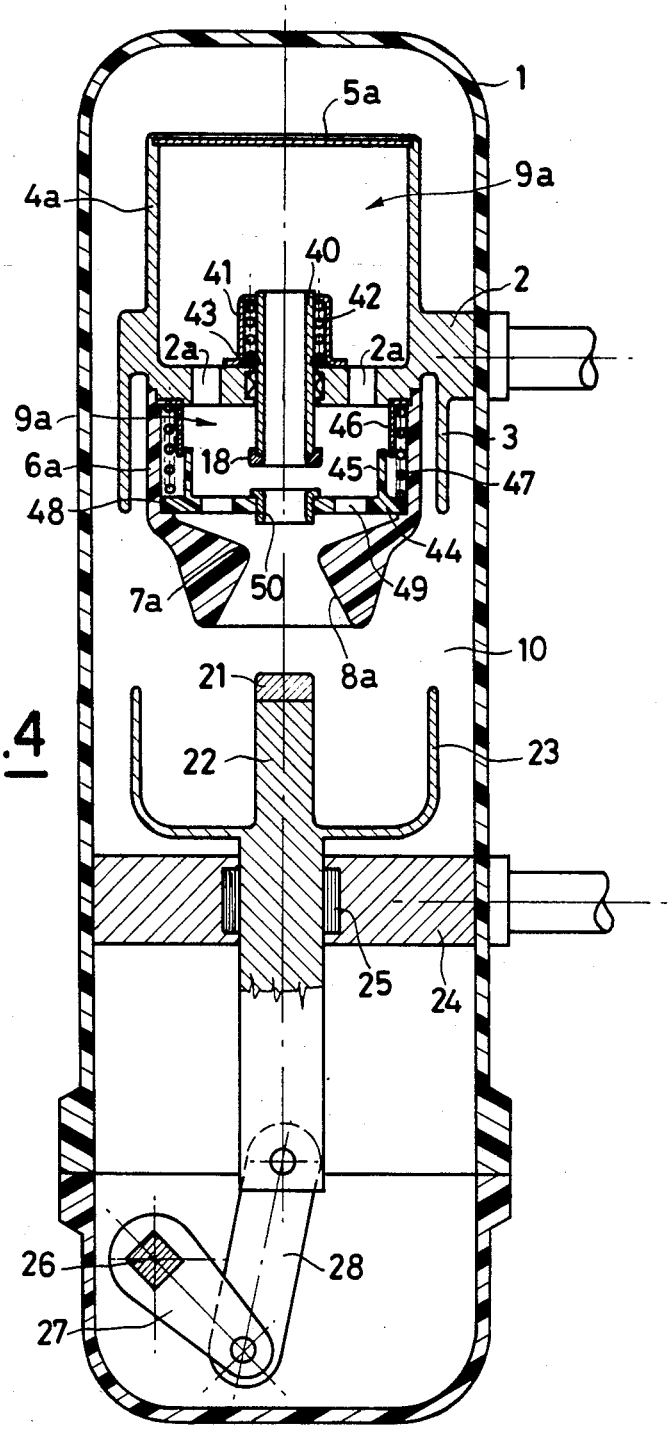

The characteristics of the invention and the advantages deriving therefrom will be more apparent from the detailed description given hereinafter with reference to the accompanying drawings, in which:

FIGS. 1 and 2 are longitudinal sections through a pole of the switch with the arc extinguishing device in a first embodiment, the contacts shown closed and open respectively; and FIGS. 3 and 4 are views analogous to the first two figures, but of a second embodiment.

The pole shown in FIGS. 1 and 2 is constituted by an insulating container 1 tight against pressurized gas, which gas, for example sulphur hexafluoride, fills the container interior and is able to ensure the required dielectric strength, and is also used as the quenching medium for the interruption arc.

Fixed main contacts 3 are fitted to an upper connector 2 of electrically conducting material, and partially surround at a certain distance therefrom a cylindrical wall 4 which is also rigid with the connector 2 and is closed upperly by an end wall 5, and extends lowerly in the form of a wall of insulating material 6 which starting with an initial cylindrical shape narrows conically to form a nozzle 7 having a diverging extension 8.

The walls 4, 5 and 6 define a compression chamber 9 which by way of the nozzle 7 can be put into communication with the inner compartment 10 of the container 1 constituting a compensation chamber. Inside the compression chamber 9 there is provided a second cylindrical wall 11 spaced apart from and coaxial to the cylindrical wall 4, said second cylindrical wall 11 extending lowerly in the form of a cylindrical wall 12 of insulating material. The upper edge of the cylindrical wall 12 forms a step 13 on the inside of the cylindrical wall 11, whereas its lower edge 14 is bent inwards. A further step 15 is also formed on the inside of the cylindrical wall 12. It should be noted that the cylindrical wall 11 and its integral cylindrical extension 12 are carried by the end wall 5, and that between the cylindrical walls 4 and 11 and their respective extensions there is an interspace 16 which communicates upperly by way of apertures 17 in the cylindrical wall 11 with the space which is enclosed by this latter, whereas lowerly it opens in a direction towards the nozzle 7.

Within the cylindrical walls 11 and 12 there is mounted an arcing contact system comprising a first pair of mutually cooperating arcing contacts 18, 19 and a second arcing contact 20 cooperating with an arcing contact 21 carried by a movable contact rod 22. The rod 22 also carries the mobile main contact 23 which cooperates with the fixed main contacts 3 and is guided axially slidable in a lower connector 24 by way of a sliding contact 25. The movable rod 22 can be moved in order to undergo a path of travel in which it opens the contacts and a path of travel in which it closes the contacts by a shaft 26 by way of a lever 27 and a connecting rod 28.

Returning to the arcing contact system, the following should be noted. The contact 18 of the first pair of arcing contacts 18, 19 is carried at the centre of a slide 29 and is in the form of a tubular stub. By way of a cylindrical peripheral part 30, the slide 29 is in electrically conducting sliding contact with the inner surface of the cylindrical wall 11, and is subjected to the action of a spring 31 acting between the slide 29 and the end wall 5 and tending to urge the slide 29 with the arcing contact 18 towards the step 13 formed by the upper edge of the insulating wall 12. A nozzle member 32 of insulating material is also fixed upperly on the slide 29.

The second contact 19 of said first pair of arcing contacts 18, 19 is of hollow tulip form and is mounted on a closed hollow cylindrical member 33, of which the only exit is that by way of the tulip contact 19. The cylindrical member 33 is disposed in a mobile manner within the insulating cylindrical wall 12, and between a lower projecting peripheral edge 34 thereof and the inner step 15 of the wall 12 there acts a spring 35 which tends to move the entire member 33 downwards as far as the bent edge 14 of the wall 12.

The lower wall of the cylindrical member 33 comprises a central projecting stem 36 which carries the second arcing contact 20 cooperating with the arcing contact 21 of the rod 22.

The hollow cylindrical member 33 thus constitutes a mobile arcing contact support element and is constructed of conducting material. The interior of the member 33 forms an auxiliary chamber 37 which, when the contacts are in their closed position shown in FIG. 1, communicates with the chamber 9 by way of the hollow arcing contacts 19, 18, the nozzle 32, a chamber 38 formed between the slide 29 and the end wall 5, the apertures 17 in the cylindrical wall 11 and the interspace 16. All these spaces together constitute a constant fixed-volume compression chamber which can be put into communication with the compensation chamber 10 by way of the nozzle 7. As can be seen on the drawings, the closure and opening of the nozzle 7 are controlled by the movable contact rod 22.

It should be noted that the arcing contacts 18, 19 and 20, 21 are electrically in series with each other, and the entire series assembly of arcing contacts is in parallel with the main contacts 3, 23.

When the movable contact rod 22 is in its upper end position, the main contacts 3, 23 and the two pairs of arcing contacts 18, 19 and 20, 21 are closed, and the current passes through the upper connector 2 and lower connector 24 by way of the main contacts and in parallel through the two pairs of arcing contacts. Both the arcing contact support element 33 and the arcing contact support slide 29 are moved upwards by the rod 22 against the respective return springs 35 and 31. During the opening stage, when the rod undergoes its path of travel from the position shown in FIG. 1 to that shown in FIG. 2, the mobile main contact 23 firstly separates from the fixed main contacts 3 and the electric current is transferred to the two pairs of arcing contacts 18, 19 and 20, 21 in series. When a sufficient distance between the main contacts 3, 23 has been attained for isolating purposes, the slide 29 carrying the arcing contact 18 of the first pair of arcing contacts and which in this stage of the opening travel undergone by the rod 22 has followed its movement under the thrust of the spring 31, halts against the step 13, so that separation of the contacts 18, 19 of the first pair of arcing contacts commences and a primary auxiliary arc is generated between these arcing contacts, whereas the arcing contacts 20, 21 of the second pair still remain closed. This auxiliary arc generates a quenching gas pressure by heating and decomposition, which pressure becomes established in all the constituent spaces of the gas compression and collection chamber which is closed at the nozzle 7 by the rod 22.

As the rod 22 continues its path of opening travel, the arcing contact support element 33 follows its movement under the thrust of the spring 35 until said element is halted with its projecting lower edge 34 against the bent edge 14 of the cylindrical wall 12. At this moment, as the rod 22 continues its path of opening travel, the arcing contacts 20 and 21 of the second pair separate and thus a second main arc is generated between these two arcing contacts, in series with the auxiliary arc formed between the arcing contacts 18 and 19. This second main arc then extends longitudinally through the nozzle 7 as soon as the rod 22 with the arcing contact 21 frees the passage through said nozzle, to thus allow the compressed quenching gas to escape from the compression chamber into the compensation chamber 10. The blast of quenching gas thus strikes the movable contact rod 22, namely at its arcing contact 21, to encounter the main arc and determine electric current interruption at the first current zero, with extinguishing of the main arc.

The geometry of the two pairs of arcing contacts 18, 19 and 20, 21 and the relative distances are calculated such that any restriking of the main arc also determines the regeneration of the auxiliary arc, so that the previously described operating conditions are reestablished, and interruption takes place at the next current zero.

The alternative embodiment shown in FIGS. 3 and 4 is similar to that heretofore described, so that the same reference numerals are used for those parts which perform the same functions.

However, in this case the cylindrical wall 4*a* rigid with the upper connector 2 extends upwards from this connector and therefore does not lie within the fixed main contacts 3, and these instead surround the wall of insulating material 6*a* which extends downwards from the connector 2 and, after an initial cylindrical portion, forms the nozzle 7*a* with the diverging extension 8*a*. The cylindrical wall 4*a* is closed upperly by an end wall 5*a* in order to define, together with the insulating wall 6*a*, the single compression chamber 9*a* which can be put into communication wih the compensation chamber 10 by way of the nozzle 7*a*, which is closable by the movable contact rod 22. The upper connector 2 comprises passage apertures 2*a* for connecting together the upper part and lower part of the compression chamber 9*a*.

A tubular element 40 carrying at its lower end the arcing contact 18 of the first pair of arcing contacts is guided centrally in the upper connector 2 with electrically conducting sliding contact. The upper part of the tubular element 40 is surrounded by a housing 41 fixed upperly to the connector 2 and containing a spring 42 concentric to the tubular element 40 and acting between the top of the housing 41 and a flange 43 rigid with the tubular element 40. It is apparent that the spring 42 tends to downwardly urge the tubular element 40 with the arcing contact 18 until the flange 43 halts against the connector 2 (see FIG. 4).

An insulating arcing contact support disc 44 is disposed axially slidable within the cylindrical part of the insulating wall 6*a*. To enable this disc to be guided axially, it is provided with an upwardly projecting axial cylindrical ring 45 slidable on an axial cylindrical ring 46 rigid with the connector 2 and projecting downwards therefrom. Between the connector 2 and disc 44 there also acts a spring 47 which tends to downwardly urge the disc 44 as far as a halt step 48 formed on the inside of the wall 6*a* (see FIG. 4).

The disc 44 comprises passage holes 49 which connect the space above the disc to that below the disc within the cylindrical wall 6*a*. Centrally, the disc 44 carries a single tubular arcing contact 50, the upper end of which is designed to cooperate with the arcing contact 18 to form therewith the first pair of arcing contacts, whereas its lower end is designed to cooperate with the arcing contact 21 carried by the movable contact rod 22 to form therewith the second pair of arcing contacts.

Again in this case, the two pairs of arcing contacts are electrically in series with each other and in parallel with the main contacts.

The operation of this embodiment of the switch is entirely analogous to that of the first embodiment.

FIG. 3 shows the condition in which both the main contacts 3, 23 and the two pairs of arcing contacts 18, 50 and 50, 21 are closed. The rod 22 is in its upper end position, and both the tubular element 40 carrying the arcing contact 18 and the disc 44 carrying the arcing contact 50 have been moved upwards by the rod 22 against the action of the respective springs 42 and 47.

During the opening stage, when the rod is moved from the position of FIG. 3 to that of FIG. 4, the main contacts 3 and 23 firstly separate. Subsequently, when the tubular element 40 terminates its stroke under the thrust of the spring 42 to halt its flange 43 against the connector 2, the arcing contacts 18, 50 of the first pair separate and a first auxiliary arc is generated between these contacts. The compression chamber 9*a* is closed and a quenching gas pressure is generated therein by the effect of the auxiliary arc.

Subsequently, the disc 44 urged by the spring 47 is also halted against the step 48, and consequently the second main arc is generated between the arcing contacts 50 and 21. When this latter contact leaves the nozzle 7*a*, so freeing its passage, the quenching gas compressed in the chamber 9*a* can escape into the chamber 10, and the blast of gas in this case encounters both the arcs in series.

Again in this case, by suitable dimensioning and coordination it is possible to obtain interruption at the first current zero after separation of the arcing contacts of the second pair thereof. From the aforegoing description it is apparent that the proposed design according to the invention provides for generating an over-pressure of quenching gas exclusively by virtue of generating an auxiliary arc within a compression chamber of suitably calculated constant volume, so that other systems for generating blasts, such as mechanical compression systems comprising pistons and magnetic blowout coils are dispensed with, and preset valve means and a plurality of successive chambers are also absent.

Because of the presence of two pairs of arcing contacts in series, themselves being in parallel with but separate from the main contacts, and the fact that the interrupting part with the blasting nozzle is grouped substantially within the group of fixed main contacts, it has been possible to obtain considerable constructional simplification and small overall size, with a reduction in the opening travel and speed and in the energy used for the operation. The movable contact rod does not need to be hollow or comprise discharge orifices.

I claim:

1. A high-voltage electric switch with an arc extinguishing device using self-generation of a quenching fluid pressure, comprising a hermetically sealed insulating container filled with said quenching fluid and divided by an at least partly insulating separation wall into a compression chamber and a compensation chamber, contacts disposed in said compression chamber and a movable contact rod mobile through an aperture in said separation wall in order to connect together said two chambers after a determined path of its opening travel, said contacts disposed in the compression chamber being arranged to create, in cooperation with the movable contact rod during its opening travel, two arcs in succession, of which one is a primary auxiliary arc for generating the quenching fluid pressure for extinguishing a second main interruption arc, characterised in that the compression chamber has a fixed volume and is at least partly surrounded by fixed main contacts cooperating with mobile main contacts carried by said movable contact rod, there being disposed inside the compression chamber in a manner movable to a limited extent by the movable contact rod during its closure travel against the action of elastic means a first pair of cooperating arcing contacts designed to create the primary auxiliary arc and a second contact cooperating with the movable contact rod and designed to create the main interruption arc therewith, said arcing contacts being electrically in parallel with the main contacts and in series with each other.

2. A switch as claimed in claim 1, characterised in that one contact of said first pair of arcing contacts is mounted movable to a limited extent against the action of autonomous first elastic means, whereas the second contact of said first pair of arcing contacts is rigid with said second arcing contact cooperating with the movable contact rod and forms therewith a freely movable element subjected to the action of separate second elastic means.

3. A switch as claimed in claim 2, characterised in that the element carrying said two arcing contacts is constituted by a closed hollow member mounted in a movable manner in the compression chamber, the interior of said hollow member forming an auxiliary chamber which is in communication with the compression chamber by way of the hollow arcing contacts constituting the first pair of arcing contacts.

4. A switch as claimed in claim 3, characterised in that there is provided in the compression chamber a cylindrical guide wall comprising stops for the movable element carrying the arcing contact cooperating with the movable contact rod and the second hollow arcing contact of the first pair of arcing contacts, and for a slide carrying the first hollow arcing contact of said first pair of arcing contacts, said cylindrical guide wall being provided with through holes which put its interior into communication with the compression chamber.

5. A switch as claimed in claim 2, characterised in that the element carrying the two arcing contacts is constituted by a disc mounted in a movable manner in the compression chamber, the two arcing contacts being combined into a single tubular piece which traverses said disc and is also provided with passage holes, one end of said tubular piece cooperating with the movable contact rod and its other end cooperating with the first arcing contact of the first pair of arcing contacts.

6. A switch as claimed in claim 5, characterised in that said first arcing contact of the first pair of arcing contacts is constituted by a tubular element mounted movable to a limited extent in a transverse dividing wall of the compression chamber, which is provided with passage holes.

* * * * *